US011536233B2

(12) United States Patent
Spegar et al.

(10) Patent No.: US 11,536,233 B2
(45) Date of Patent: Dec. 27, 2022

(54) FUEL SYSTEM FOR AN INTERNAL COMBUSTION ENGINE

(71) Applicant: DELPHI TECHNOLOGIES IP LIMITED, St. Michael (BB)

(72) Inventors: Timothy D. Spegar, Honeoye Falls, NY (US); Joseph G. Spakowski, Rochester, NY (US)

(73) Assignee: DELPHI TECHNOLOGIES IP LIMITED, St. Michael (BB)

( * ) Notice: Subject to any disclaimer, the term of this patent is extended or adjusted under 35 U.S.C. 154(b) by 0 days.

(21) Appl. No.: 17/405,166

(22) Filed: Aug. 18, 2021

(65) Prior Publication Data

US 2022/0082071 A1 Mar. 17, 2022

Related U.S. Application Data

(60) Provisional application No. 63/078,720, filed on Sep. 15, 2020.

(51) Int. Cl.

| | |
|---|---|
| ***F02M 55/04*** | (2006.01) |
| ***F02M 59/20*** | (2006.01) |
| ***F02M 37/00*** | (2006.01) |
| ***F02M 55/02*** | (2006.01) |

(52) U.S. Cl.

CPC ..... *F02M 59/205* (2013.01); *F02M 37/0041* (2013.01); *F02M 55/025* (2013.01)

(58) Field of Classification Search

CPC ..... F02D 41/3845; F02D 2200/0602; F02D 41/3863; F02D 2041/3881; F02D 41/3854; F02D 41/402; F02M 55/04

USPC ..... 123/447

See application file for complete search history.

(56) References Cited

U.S. PATENT DOCUMENTS

| | | | |
|---|---|---|---|
| 5,354,183 | A | 10/1994 | Eisenbacher et al. |
| 7,263,973 | B2 | 9/2007 | Akita et al. |
| 8,727,752 | B2 | 5/2014 | Lucas |
| 8,973,556 | B2 | 3/2015 | Hoefner et al. |
| 9,145,860 | B2 | 9/2015 | Usui et al. |
| 9,422,897 | B2 | 8/2016 | Hoefner et al. |
| 9,989,022 | B2 | 8/2018 | Spakowski et al. |
| 2003/0108443 | A1 | 6/2003 | Suzuki et al. |

(Continued)

FOREIGN PATENT DOCUMENTS

| | | | | |
|---|---|---|---|---|
| DE | 112007003232 | T5 * | 12/2009 | ..... F02M 55/04 |
| DE | 102010043112 | B4 | 9/2019 | |
| WO | 2008009974 | A2 | 1/2008 | |

*Primary Examiner* — George C Jin
*Assistant Examiner* — Teuta B Holbrook
(74) *Attorney, Agent, or Firm* — Joshua M. Haines

(57) ABSTRACT

A fuel system includes a low-pressure fuel delivery unit and a high-pressure fuel delivery unit which has a low-pressure region and a high-pressure region such that the low-pressure region supplies fuel to the high-pressure region which supplies the fuel to a plurality of high-pressure fuel injectors. A low-pressure fuel rail supplies fuel to low-pressure fuel injectors. A low-pressure fuel injector line is connected at a first end directly to the high-pressure fuel delivery unit and receives fuel from the low-pressure region and is connected at a second end directly to the low-pressure fuel rail, thereby providing fluid communication from the low-pressure region to the low-pressure fuel rail. A device is located between the low-pressure region and the low-pressure fuel rail and reduces fuel pressure pulsations.

8 Claims, 4 Drawing Sheets

(56) References Cited

U.S. PATENT DOCUMENTS

| | | | | |
|---|---|---|---|---|
| 2004/0197216 | A1 | 10/2004 | Kuroda | |
| 2009/0068041 | A1 | 3/2009 | Beardmore | |
| 2010/0162553 | A1* | 7/2010 | Matsuki | B23K 26/125 219/121.64 |
| 2011/0017332 | A1* | 1/2011 | Bartsch | B60T 8/42 138/30 |
| 2011/0097228 | A1* | 4/2011 | Tokuo | F02M 69/465 417/505 |
| 2012/0279474 | A1* | 11/2012 | Hoefner | F02M 43/00 123/448 |
| 2012/0312278 | A1* | 12/2012 | Usui | F02M 55/04 123/446 |
| 2015/0285166 | A1* | 10/2015 | Surnilla | F02D 19/0605 123/294 |
| 2016/0090955 | A1* | 3/2016 | Yuasa | F02M 55/04 123/457 |
| 2016/0131097 | A1* | 5/2016 | Matsuo | F02M 55/04 123/495 |
| 2016/0169251 | A1 | 6/2016 | Prouzet et al. | |
| 2016/0377018 | A1 | 12/2016 | Sanborn et al. | |
| 2017/0167450 | A1* | 6/2017 | Spakowski | F02M 37/08 |
| 2017/0204803 | A1* | 7/2017 | Pursifull | F02D 41/3845 |
| 2017/0292485 | A1* | 10/2017 | Nah | F02M 59/46 |
| 2017/0306880 | A1* | 10/2017 | Nakaoka | F02M 59/367 |

* cited by examiner

FUEL SYSTEM FOR AN INTERNAL COMBUSTION ENGINE

CROSS-REFERENCE TO RELATED PATENT APPLICATIONS

This patent application claims the benefit of U.S. provisional patent application Ser. No. 63/078,720 filed on Sep. 15, 2020, the disclosure of which is hereby incorporated by reference in its entirety.

TECHNICAL FIELD OF INVENTION

The present disclosure relates to a fuel system for an internal combustion engine; more particularly to a fuel system which includes a portion for delivering fuel directly to the combustion chamber of the internal combustion engine at a relatively high pressure and a portion for delivering fuel upstream of the combustion chamber at a relatively low pressure; and still even more particularly to a fuel system where a high-pressure fuel delivery unit is cooled and lubricated even when little or no fuel is delivered directly to the combustion chamber.

BACKGROUND OF INVENTION

Fuel systems for modern internal combustion engines typically employ either 1) port fuel injection (PFI) where fuel is injected into an air intake manifold or other combustion air passage of the internal combustion engine at relatively low pressure (typically below about 500 kPa) and subsequently passed to the combustion chamber of the internal combustion engine or 2) gasoline direct injection (GDi) where fuel is injected directly into the combustion chamber of the internal combustion engine at relatively high pressure (typically above about 14 MPa). However, some fuel systems have been developed which employ both PFI and GDi in order to take advantage of operating modes where PFI provides operational benefits and in order to take advantage of operating modes where GDi provides operational benefits. Consequently, only the PFI may be utilized under some operating conditions while only GDi may be utilized under other operating conditions. One example of a fuel system which employs both PFI and GDi is described in U.S. Pat. No. 7,263,973 to Akita et al.; however, a disadvantage of the system of Akita et al. is that when only the PFI system is used, the high-pressure fuel pump used to pressurize the fuel in the GDi system continues to be cycled by a camshaft of the internal combustion engine. This cycling, along with the close proximity of the high-pressure fuel pump to the internal combustion engine, causes fuel in the high-pressure fuel pump to elevate in temperature and potentially create vapor in the GDi system which is undesirable for the high-pressure fuel pump and which may hinder fueling when the GDi system is used.

U.S. Pat. No. 8,973,556 to Hoefner et al. describes another fuel system which employs both PFI and GDi. Hoefner et al. provides an arrangement where fuel that is used in both the PFI system and GDi system is first supplied to a drive section of the high-pressure fuel pump. Consequently, when only the PFI system is used, fuel flows through the drive section of the high-pressure fuel pump, thereby providing lubrication and cooling to the high-pressure fuel pump. However, the PFI system of Hoefner et al. may be susceptible to pressure pulsations.

What is needed is a fuel system which minimizes or eliminates one or more of the shortcomings as set forth above and provides an alternative to the fuel systems as set forth above.

SUMMARY OF THE INVENTION

Briefly described, a fuel system for an internal combustion engine is provided which includes a low-pressure fuel delivery unit; a high-pressure fuel delivery unit which has a low-pressure region and a high-pressure region such that the low-pressure region supplies fuel to the high-pressure region and such that the high-pressure region pressurizes fuel and supplies the fuel pressurized by the high-pressure region to a plurality of high-pressure fuel injectors; a low-pressure fuel rail which supplies fuel to a plurality of low-pressure fuel injectors; a low-pressure fuel injector line which is 1) connected at a first end thereof directly to the high-pressure fuel delivery unit and receives fuel from the low-pressure region and 2) connected at a second end thereof directly to the low-pressure fuel rail, thereby providing fluid communication from the low-pressure region to the low-pressure fuel rail; and a means for reducing fuel pressure pulsations, the means for reducing fuel pressure pulsations being located between the low-pressure region and the low-pressure fuel rail. The fuel system with means for reducing fuel pressure pulsations allows the high-pressure fuel delivery unit to be lubricated and cooled even when only the low-pressure fuel injectors are being used to supply fuel to the internal combustion engine. Furthermore, audible noise that is objectionable, cylinder-to-cylinder fuel delivery variation, and other adverse effects caused by pressure pulsations between the high-pressure fuel delivery unit and the low-pressure fuel rail are minimized. Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
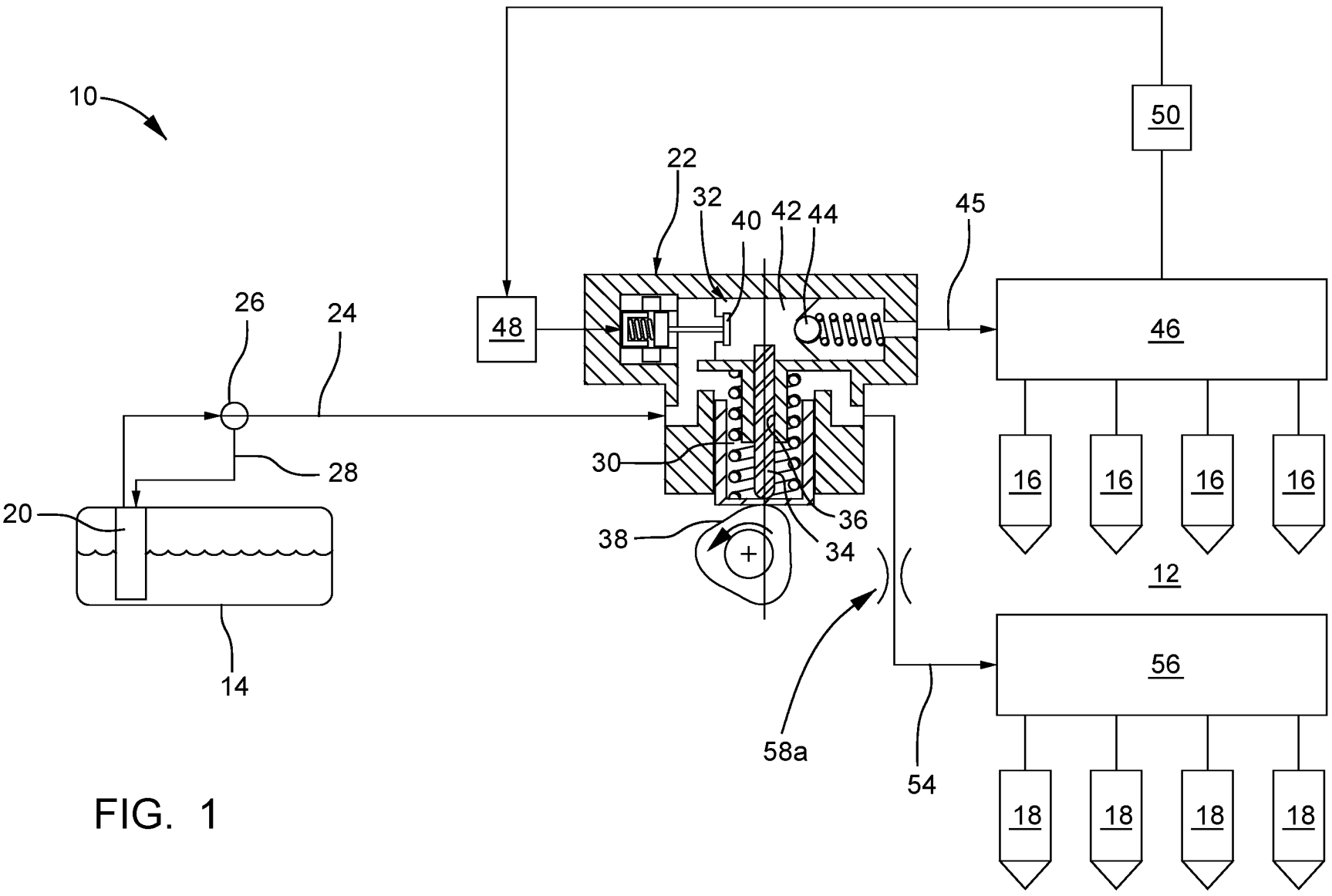
FIGS. 1-4 are schematic views of fuel systems in accordance with the present disclosure.

In accordance with a preferred embodiment of this disclosure and referring to FIG. 1, a fuel system 10 for an internal combustion engine 12 is shown. Fuel system 10 generally includes a fuel tank 14 which holds a volume of fuel to be supplied to internal combustion engine 12 for operation thereof; a plurality of high-pressure fuel injectors 16 which inject fuel directly into respective combustion chambers (not shown) of internal combustion engine 12; a plurality of low-pressure fuel injectors 18 which inject fuel into an air intake manifold or other combustion air passage (not shown) of internal combustion engine 12 where the fuel mixes with air and is subsequently passed to the combustion chambers through respective intake valves (not shown); a low-pressure fuel delivery unit 20; and a high-pressure fuel delivery unit 22 where the low-pressure fuel delivery unit 20 draws fuel from fuel tank 14 and elevates the pressure of the fuel for delivery to high-pressure fuel delivery unit 22 and to low-pressure fuel injectors 18 and where the high-pressure fuel delivery unit 22 further elevates the pressure of the fuel for delivery to high-pressure fuel injectors 16. By way of non-limiting example only, low-pressure fuel delivery unit 20 may elevate the pressure of the fuel to about 500 kPa or less and high-pressure fuel delivery unit 22 may elevate the pressure of the fuel to above about 14 MPa. Depending on the operating conditions and desired performance, selection can be made to deliver fuel to the combustion chambers by high-pressure fuel injectors 16 or by low-pressure fuel injectors 18. It is also contemplated that fuel may be delivered to the combustion chambers by both high-pressure fuel injectors 16 and by low-pressure fuel injectors 18 concurrently. While four high-pressure fuel injectors 16 and four low-pressure fuel injectors 18 have been illustrated, it should be understood that a lesser or greater number of each of high-pressure fuel injectors 16 and low-pressure fuel injectors 18 may be provided. The various elements of fuel system 10 will be described in greater detail in the paragraphs that follow.

As shown, low-pressure fuel delivery unit 20 may be provided within fuel tank 14, however low-pressure fuel delivery unit 20 may alternatively be provided outside of fuel tank 14. Low-pressure fuel delivery unit 20 may be an electric fuel pump. A low-pressure fuel supply passage 24 provides fluid communication from low-pressure fuel delivery unit 20 to high-pressure fuel delivery unit 22. A fuel pressure regulator 26 may be provided such that fuel pressure regulator 26 maintains a substantially uniform pressure within low-pressure fuel supply passage 24 by returning a portion of the fuel supplied by low-pressure fuel delivery unit 20 to fuel tank 14 through a fuel return passage 28. While fuel pressure regulator 26 has been illustrated in low-pressure fuel supply passage 24 outside of fuel tank 14, it should be understood that fuel pressure regulator 26 may be located within fuel tank 14 and may be integrated with low-pressure fuel delivery unit 20.

High-pressure fuel delivery unit 22 includes a low-pressure region 30 and a high-pressure region 32. High-pressure fuel delivery unit 22 may be a plunger pump which is mechanically driven by internal combustion engine 12 such that low-pressure region 30 includes a pumping plunger 34 which is reciprocated within a plunger bore 36 by a rotating camshaft 38 of internal combustion engine 12. High-pressure region 32 includes an inlet valve 40, a pumping chamber 42, and an outlet valve 44. Low-pressure region 30 includes all of the portions of high-pressure fuel delivery unit 22 that are in fluid communication with low-pressure fuel supply passage 24 when inlet valve 40 is closed. The fuel within pumping chamber 42 is pressurized by reciprocation of pumping plunger 34, and when the pressure within pumping chamber 42 is sufficiently high, outlet valve 44 is caused to open. Fuel that exits high-pressure fuel delivery unit 22 through outlet valve 44 is communicated, via a high-pressure fuel passage 45, to a high-pressure fuel rail 46 with which each of high-pressure fuel injectors 16 are in fluid communication. Inlet valve 40 may be, by way of non-limiting example only, a solenoid operated valve which is controlled by a controller 48. Controller 48 may receive input from a pressure sensor 50 which supplies a signal indicative of the pressure of the fuel being supplied to high-pressure fuel injectors 16. While pressure sensor 50 is shown arranged to read the fuel pressure within high-pressure fuel rail 46, it should be understood that pressure sensor 50 may be positioned at other locations that are indicative of the pressure of the fuel being supplied to high-pressure fuel injectors 16. Controller 48 sends signals to inlet valve 40 to open and close inlet valve 40 as necessary to achieve a desired fuel pressure at pressure sensor 50 as may be determined by current and anticipated engine operating demands. When inlet valve 40 is opened while pumping plunger 34 is moving to increase the volume of pumping chamber 42, fuel from low-pressure fuel supply passage 24 is allowed to flow into pumping chamber 42.

A low-pressure fuel injector supply passage 54 is connected at one end directly to high-pressure fuel delivery unit 22, more particularly to low-pressure region 30 and even more particularly to the portion of low-pressure region 30 which surrounds pumping plunger 34, and is connected at its other end directly to a low-pressure fuel rail 56 with which each of low-pressure fuel injectors 18 are in fluid communication. Low-pressure fuel injector supply passage 54 provides fluid communication from high-pressure fuel delivery unit 22 to low-pressure fuel rail 56. However, it is important to note that low-pressure fuel injector supply passage 54 receives fuel from high-pressure fuel delivery unit 22 without the fuel passing through pumping chamber 42. In this way, fuel passes through low-pressure region 30, without being further pressurized, thereby allowing the fuel to be supplied to low-pressure fuel rail 56 and low-pressure fuel injectors 18 at the appropriate pressure while aiding in cooling and lubrication of high-pressure fuel delivery unit 22 since fresh, relatively cool fuel from fuel tank 14 passes through low-pressure region 30 even when high-pressure fuel is not supplied to high-pressure fuel rail 46 and high-pressure fuel injectors 16.

Figure 2:
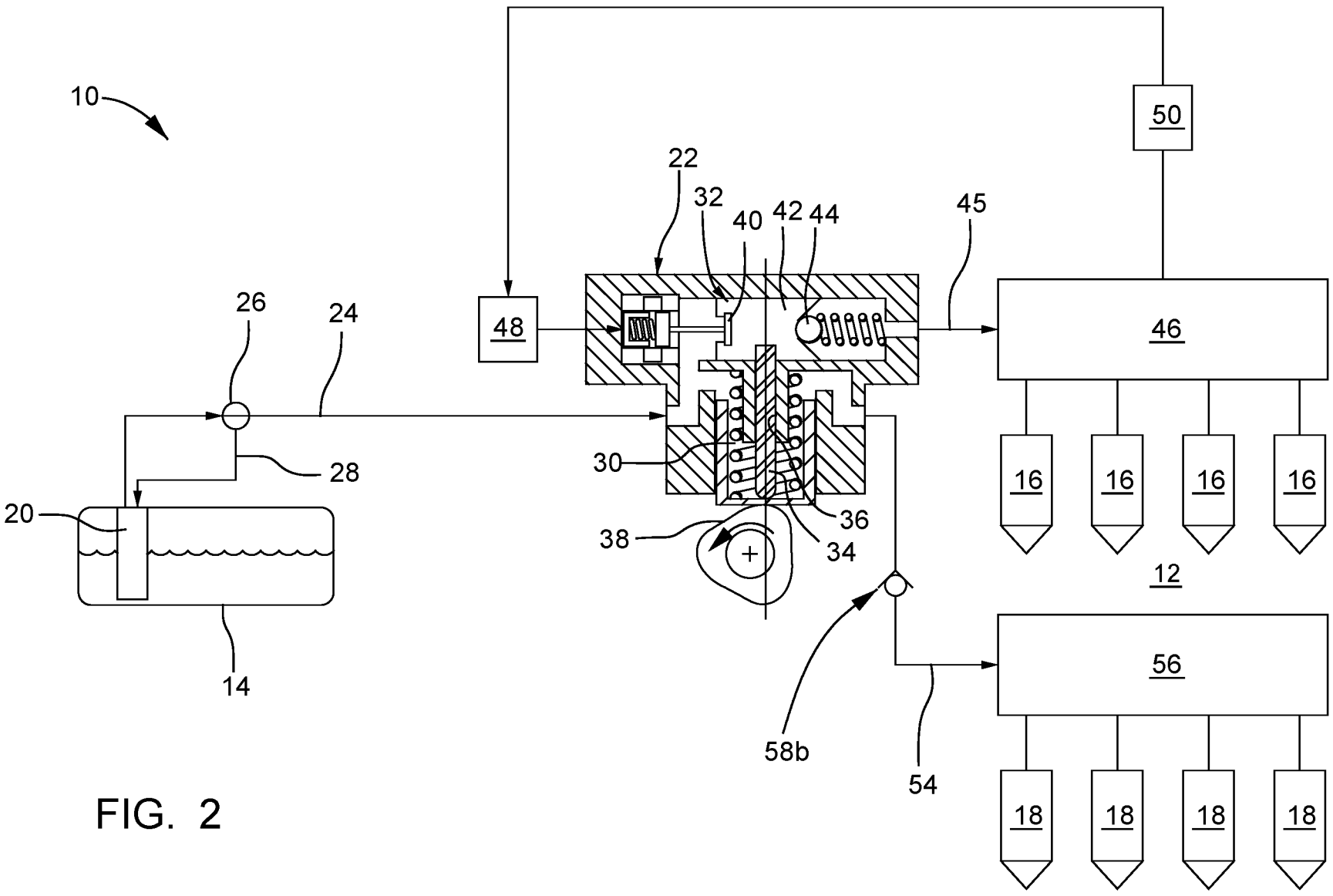
Figure 3:
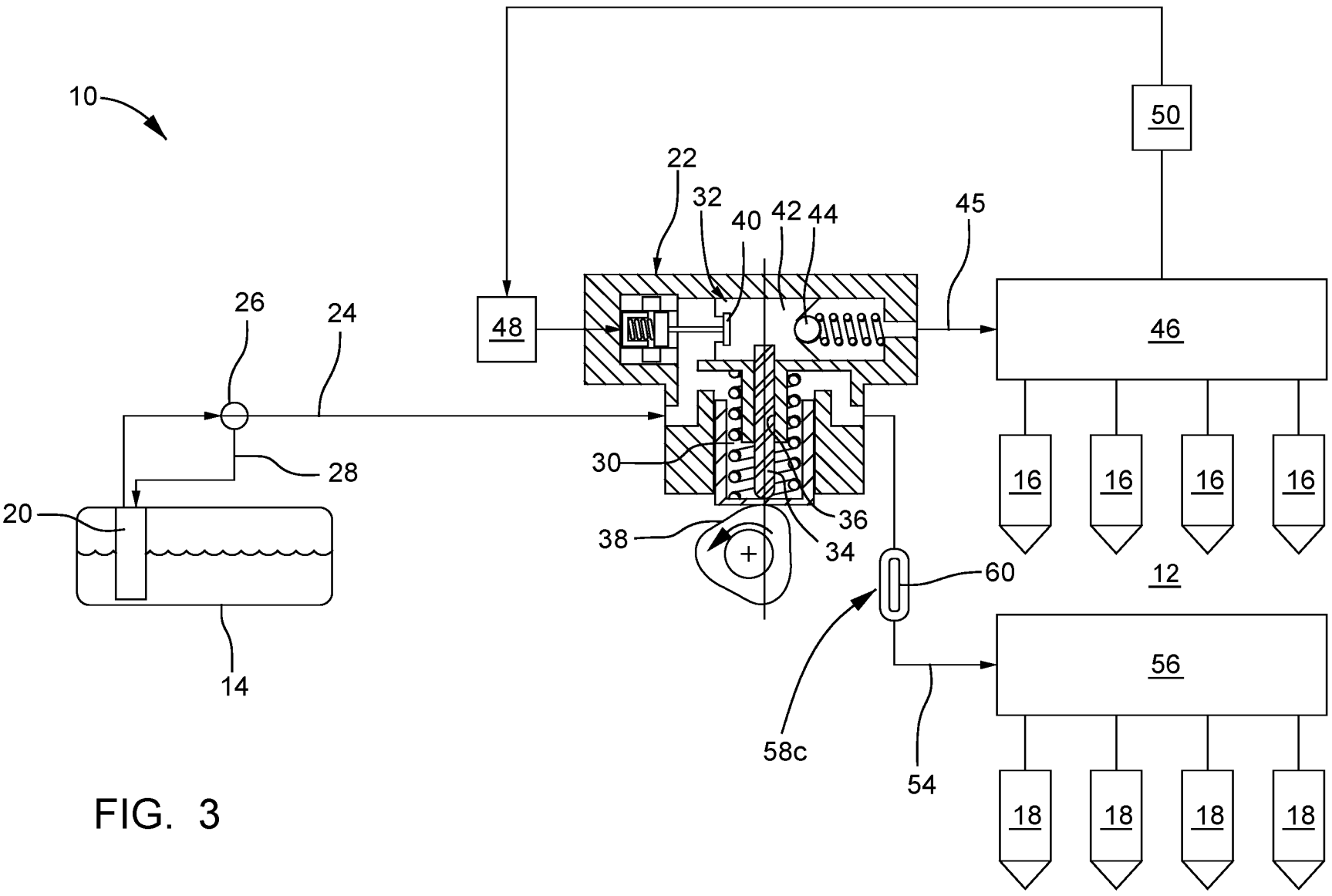
Figure 4:
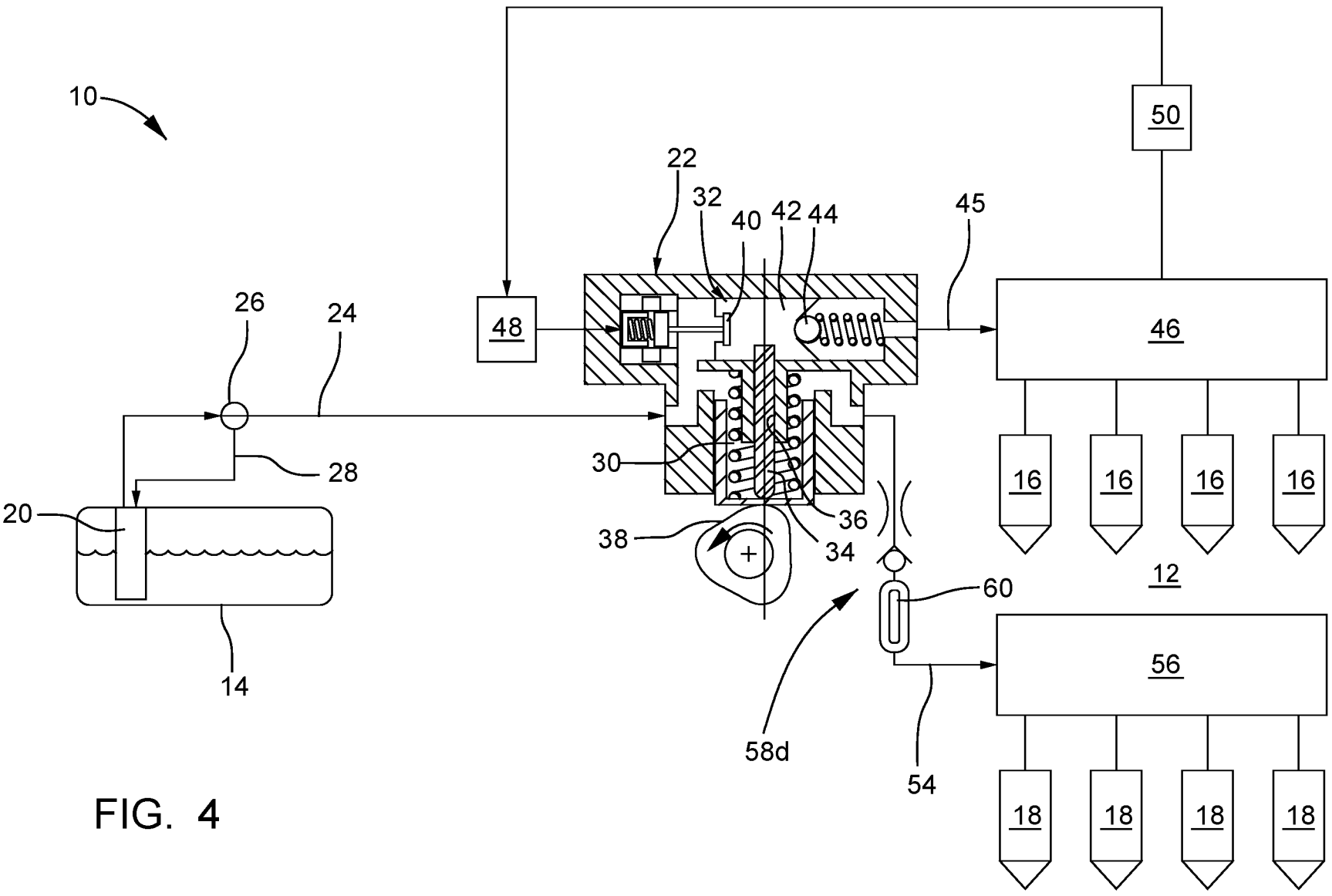

If left unmitigated, fuel pressure pulsations, initiated by injection events (opening and closing of high-pressure fuel injectors 16 or opening and closing of low-pressure fuel injectors 18) or initiated by pump operating events (charging, spilling, and pumping of high-pressure fuel delivery unit 22) can cause audible noise that is objectionable, cylinder-to-cylinder fuel delivery variation, and other adverse effects. As used herein, charging is understood to be filling pumping chamber 42 with fuel when pumping plunger 34 is moving to expand pumping chamber 42 and spilling is flowing fuel from pumping chamber 42 back to low-pressure fuel supply passage 24 and/or low-pressure region 30 when pumping plunger 34 is moving to decrease pumping chamber 42 in volume while inlet valve 40 is open (done in order to provide a desired output of fuel from high-pressure fuel delivery unit 22). In order to minimize or eliminate one or more of these results, a means for reducing fuel pressure pulsations, indicated by reference number **58*a* in FIG. 1, is provided in low-pressure fuel injector supply passage 54 between high-pressure fuel delivery unit 22 and low-pressure fuel rail 56. As illustrated in FIG. 1, means for reducing fuel pressure pulsations 58*a*, may take the form of an orifice or restriction which may either be fixed or variable. The orifice or restriction inhibits propagation of the pressure pulsation within low-pressure fuel injector supply passage 54. In an alternative shown in FIG. 2, the means for reducing fuel pressure pulsations is indicated by reference number 58*b* which takes the form of a check valve which allows fuel flow from high-pressure fuel delivery unit 22 to low-pressure fuel rail 56, but prohibits fuel flow in the opposite direction. Similar to the orifice or restriction, the check valve provides a restriction or impedance to flow which inhibits propagation of the pressure pulsation within low-pressure fuel injector supply passage 54. In another alternative shown in FIG. 3, the means for reducing fuel pressure pulsations is indicated by reference number 58*c* which takes the form of a chamber or accumulator which includes an area of enlarged cross-sectional area within low-pressure fuel injector supply passage 54. The chamber or accumulator provides an enlarged volume within which pressure pulsations may naturally reflect and decrease in magnitude. A pulsation damper 60 may be located within the chamber or accumulator such that the pulsation damper 60 is flexible and resilient in nature in order to adsorb the pressure pulsations. Pulsation damper 60 may take the form of an imperforate hollow and flexible shell which is pressurized with a gas. The pressure pulsations cause the shell of pulsation damper 60 to flex inward and the pressurized gas returns the shell to its original shape, thereby mitigating the pressure pulsations. An example of a suitable pulsation damper is described in U.S. Pat. No. 8,727,752 to Lucas, the disclosure of which is hereby incorporated by reference in its entirety. Alternatively, a wall which defines the chamber or accumulator is flexible in response to the fuel pressure pulsations in order to mitigate the fuel pressure pulsations by flexing outward, either with or without the presence of pulsation damper 60 therewithin. In yet another embodiment as shown in FIG. 4, the means for reducing fuel pressure pulsations includes two or more of the restriction or orifice of FIG. 1, the check valve of FIG. 2, and the chamber or accumulator of FIG. 3**. While all three devices have been illustrated, it should be understood that one may be omitted. It should also be understood that duplicates of some of the devices may be additionally included. Furthermore, while the devices have been illustrated as being arranged in series, it should be understood that a parallel arrangement or a combination of series and parallel may be utilized. Optimization for specific fuel system applications can be made by choosing the most effective orifice or restriction size, check valve flow rate and opening pressure, and chamber or accumulator volume and flexing characteristics. This optimization may be achieved, by way of non-limiting example only, through empirical testing or computer simulation.

In operation, when only high-pressure fuel injectors 16 are used to supply fuel to the combustion chambers of internal combustion engine 12, low-pressure fuel delivery unit 20 draws fuel from fuel tank 14 and passes the fuel to high-pressure fuel delivery unit 22 through low-pressure fuel supply passage 24. Inlet valve 40 is opened by controller 48 when pumping plunger 34 is moving to expand the volume of pumping chamber 42, thereby drawing fuel into pumping chamber 42. Inlet valve 40 is subsequently closed by controller 48, thereby allowing fuel within pumping chamber 42 to be compressed when pumping plunger 34 is moving to decrease the volume of pumping chamber 42. When the pressure of fuel within pumping chamber 42 is sufficiently high, the fuel pressure causes outlet valve 44 to open and communicate the pressurized fuel to high-pressure fuel rail 46 where high-pressure fuel injectors 16 are able to receive the pressurized fuel and inject the fuel directly into the combustion chambers of internal combustion engine 12. Since high-pressure fuel delivery unit 22 is supplying fuel to high-pressure fuel injectors 16, a constant supply of fresh, relatively cool fuel is supplied from fuel tank 14 to high-pressure fuel delivery unit 22, thereby providing lubrication and cooling to high-pressure fuel delivery unit 22.

In operation, when only low-pressure fuel injectors 18 are used to supply fuel to the combustion chambers of internal combustion engine 12, low-pressure fuel delivery unit 20 draws fuel from fuel tank 14 and passes the fuel to high-pressure fuel delivery unit 22 through low-pressure fuel supply passage 24. The fuel supplied to high-pressure fuel delivery unit 22 passes through low-pressure region 30 and exits high-pressure fuel delivery unit 22 through low-pressure fuel injector supply passage 54. The fuel then passes to low-pressure fuel rail 56 where it is distributed to low-pressure fuel injectors 18 and subsequently. Consequently, high-pressure fuel delivery unit 22 is lubricated and cooled even when only low-pressure fuel injectors 18 are used to supply fuel to the combustion chambers of internal combustion engine 12 or when low-pressure fuel injectors 18 are used to supply fuel to the combustion chambers concurrently with high-pressure fuel injectors 16 providing a low rate of fuel to the combustion chambers of internal combustion engine 12.

While this invention has been described in terms of preferred embodiments thereof, it is not intended to be so limited, but rather only to the extent set forth in the claims that follow.

We claim:

1. A fuel system for an internal combustion engine, said fuel system comprising:

a low-pressure fuel delivery unit;

a high-pressure fuel delivery unit which has a low-pressure region and a high-pressure region such that said low-pressure region supplies fuel to said high-pressure region and such that said high-pressure region pressurizes fuel and supplies the fuel pressurized by the high-pressure region to a plurality of high-pressure fuel injectors;

a low-pressure fuel rail which supplies fuel to a plurality of low-pressure fuel injectors;

a low-pressure fuel injector line which is 1) connected at a first end thereof directly to said high-pressure fuel delivery unit and receives fuel from said low-pressure region and 2) connected at a second end thereof directly to said low-pressure fuel rail, thereby providing fluid communication from said low-pressure region to said low-pressure fuel rail; and a means for reducing fuel pressure pulsations, said means for reducing fuel pressure pulsations being located between said high-pressure fuel delivery unit and said low-pressure fuel rail.

2. A fuel system as in claim 1, wherein said means for reducing fuel pressure pulsations includes a restriction.

3. A fuel system as in claim 1, wherein said means for reducing fuel pressure pulsations includes a check valve which allows fuel flow from said low-pressure region to said low-pressure fuel rail and prevents fuel flow from said low-pressure fuel rail to said low-pressure region.

4. A fuel system as in claim 1, wherein said means for reducing fuel pressure pulsations includes a chamber which provides an enlarged volume.

5. A fuel system as in claim 4, wherein said means for reducing fuel pressure pulsations includes a pulsation damper which is flexible and resilient in order to dampen pressure pulsations such that said pulsation damper is located within said chamber.

6. A fuel system as in claim 4, wherein a wall of said chamber is flexible in response to said fuel pressure pulsations.

7. A fuel system as in claim 1, wherein said means for reducing fuel pressure pulsations includes two or more of the following: 1) a restriction, 2) a check valve which allows fuel flow from said low-pressure region to said low-pressure fuel rail and prevents fuel flow from said low-pressure fuel rail to said low-pressure region, and 3) a chamber which provides an enlarged volume.

8. A fuel system as in claim 1, wherein said low-pressure fuel injector line provides a path for fuel to flow from said high-pressure fuel delivery unit to said low-pressure fuel rail without again passing through said high-pressure fuel delivery unit.

* * * * *